US007909202B1

(12) United States Patent
Gordon

(10) Patent No.: US 7,909,202 B1
(45) Date of Patent: Mar. 22, 2011

(54) LITER HOLDER

(76) Inventor: Melvin Gordon, Round Lake, IL (US)

( * ) Notice: Subject to any disclaimer, the term of this patent is extended or adjusted under 35 U.S.C. 154(b) by 183 days.

(21) Appl. No.: 12/207,712

(22) Filed: Sep. 10, 2008

(51) Int. Cl.
*B65D 25/00* (2006.01)

(52) U.S. Cl. ..... 220/742; 220/737

(58) Field of Classification Search ..... 220/737, 220/741, 742; 222/526
See application file for complete search history.

(56) References Cited

U.S. PATENT DOCUMENTS 5,092,498 A * 3/1992 Willems et al. ..... 222/526
5,680,958 A * 10/1997 Mann et al. ..... 220/739
5,897,037 A 4/1999 Mann
5,904,267 A * 5/1999 Thompson ..... 220/592.16
6,003,205 A 12/1999 Dehaven
6,651,838 B2 11/2003 Bissell
D502,366 S 3/2005 Strepkoff
2001/0040380 A1 11/2001 Forjone
2005/0121405 A1 6/2005 Drajan

* cited by examiner

*Primary Examiner* — Anthony Stashick
*Assistant Examiner* — Harry A Grosso
(74) *Attorney, Agent, or Firm* — Kyle Fletcher

(57) ABSTRACT

The present invention relates to an improved beverage support and serving system that includes a base with handle, an adjustable strap, and removable spout with cap. The invention is used by inserting a beverage bottle into the base, and securing the bottle to the base via the adjustable strap. Next, the removable spout is screwed onto the bottle.

13 Claims, 3 Drawing Sheets

LITER HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of plastic bottle serving devices.

B. Discussion of the Prior Art

As a preliminary note, it should be stated that there is an ample amount of prior art that deals with bottle supporting and holding apparatus. As will be discussed immediately below, no prior art discloses a liter holder that includes a handle and pouring attachment.

The Drajan Patent Application Publication (U.S. Pub. No. 2005/0121405) discloses a beverage bottle dispenser which is adaptable to a soda bottle and can be used as a closure or dispenser. However, the dispenser of the Drajan application does not provide a handle for holding the bottle while serving the contents contained therein.

The Forjone Patent Application Publication (U.S. Pub. No. 2001/0040380) discloses a beverage bottle holder wherein a handled harness provides the user with a means by which to grasp a conventional plastic beverage bottle, essentially transforming the bottle into a pitcher-type assembly that allows the user to pour the contents of the bottle with a great deal of ease and control. However, the beverage holder of the Forjone publication does not utilize an adjustable strap whereby a plurality of bottle sizes can be supported.

The Bissell Patent (U.S. Pat. No. 6,651,838) discloses a bottle retaining device to aid pouring. However, the bottle retaining device of the Bissell Patent does not utilize an adjustable strap that allows for a plurality of different sized bottles to be supported within the device.

The Mann Patent (U.S. Pat. No. 5,897,037) discloses a combination cap and dispensing spout assembly for a carbonated beverage bottle. However, the cap and spout of the Mann Patent does not include a handle or support base.

The Dehaven Patent (U.S. Pat. No. 6,003,205) discloses a new beverage bottle handle attachment for easy holding of a beverage bottle, in particular a two liter beverage bottle. However, the beverage bottle handle attachment does not use an adjustable strap for supporting a plurality of bottle shapes.

The Strepkoff Patent (U.S. Pat. No. Des. 502,366) illustrates a design for a bottle holder, which does not include an adjustable strap, nor a base that extends from the top of the bottle to the bottom of the bottle.

While the above-described devices fulfill their respective and particular objects and requirements, they do not describe a bottle holder that provides for the advantages of the bottle holder. In this regard, the bottle holder departs from the conventional concepts and designs of the prior art.

SUMMARY OF THE INVENTION

The present invention relates to an improved beverage support and serving system that includes a base with handle, an adjustable strap, and removable spout with cap. The invention is used by inserting a beverage bottle into the base, and securing the bottle to the base via the adjustable strap. Next, the removable spout is screwed onto the bottle.

These together with additional objects, features and advantages of the bottle holder will be readily apparent to those of ordinary skill in the art upon reading the following detailed description of presently preferred, but nonetheless illustrative, embodiments of the bottle holder when taken in conjunction with the accompanying drawings.

In this respect, before explaining the current embodiments of the bottle holder in detail, it is to be understood that the bottle holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bottle holder. It is therefore important that the claims be regarded as including such equivalent construction insofar as they do not depart from the spirit and scope of the bottle holder. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Detailed reference will now be made to the present invention, examples of which are illustrated in FIGS. 1-6. An improved bottle server 10 (hereinafter invention) includes a base 15, an adjustable strap 25, and a removable spout 35.

Figure 1:
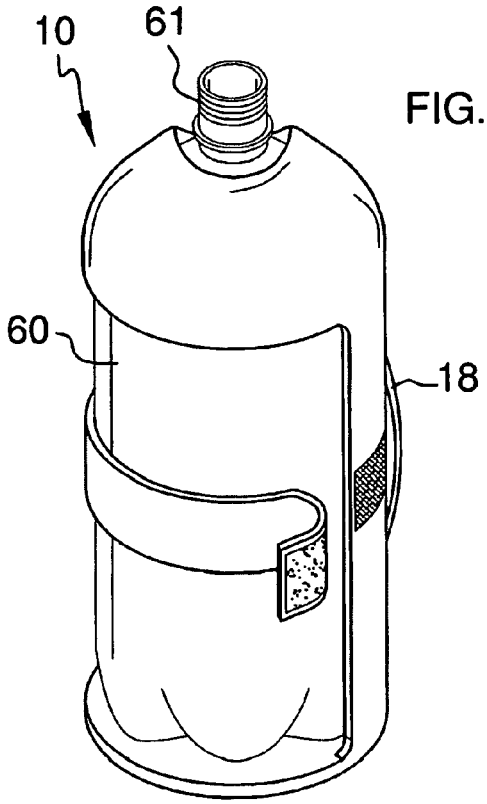
FIG. 1 illustrates an isometric view of the base, adjustable strap, and a plastic bottle.
Figure 2:
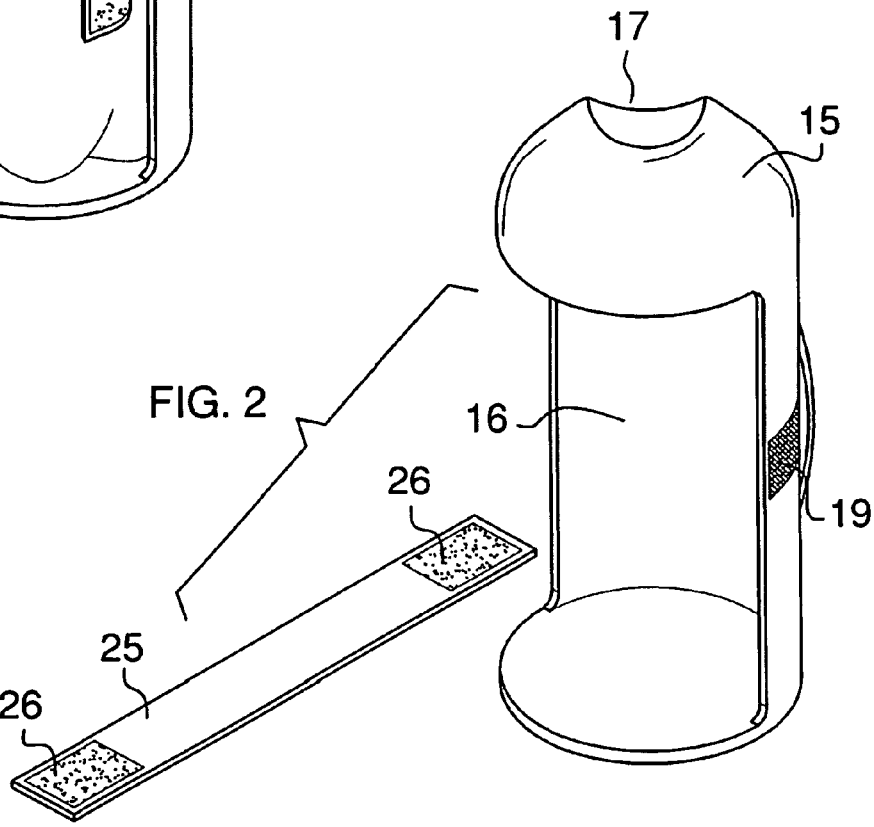
FIG. 2 illustrates a the base and the adjustable strap.
Figure 3:
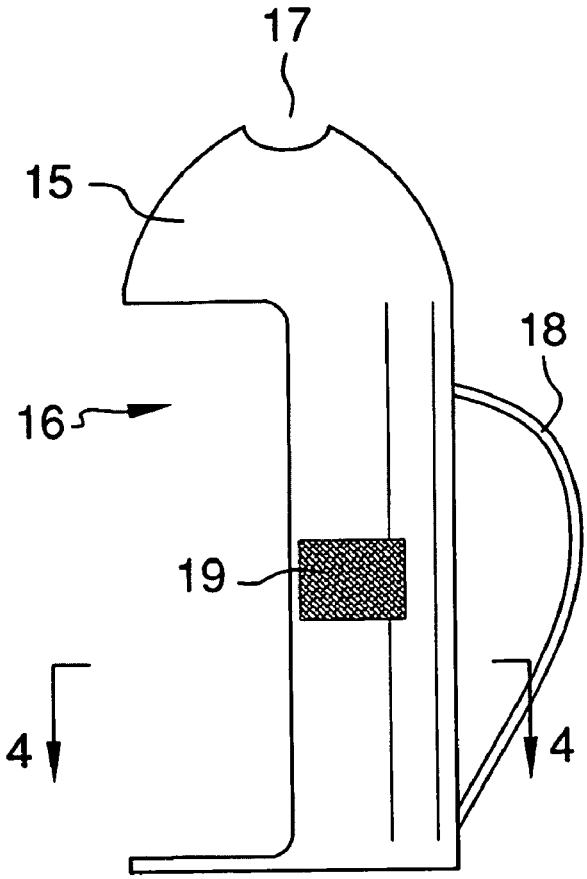
FIG. 3 illustrates a side view of the base.
Figure 4:
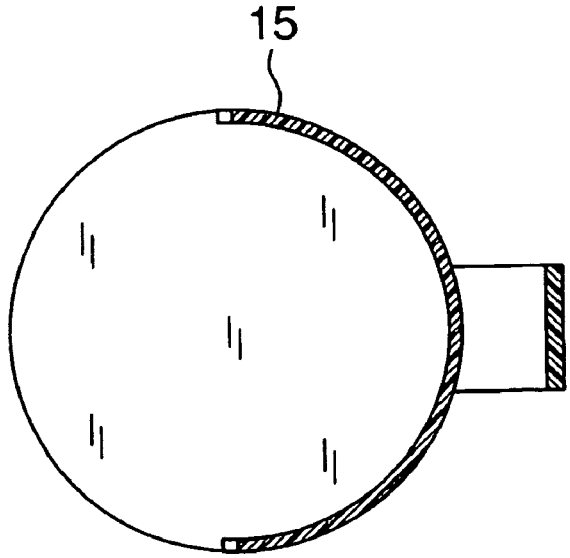
FIG. 4 illustrates a cross-sectional view of the base along line 4-4 in FIG. 3.
Figure 5:
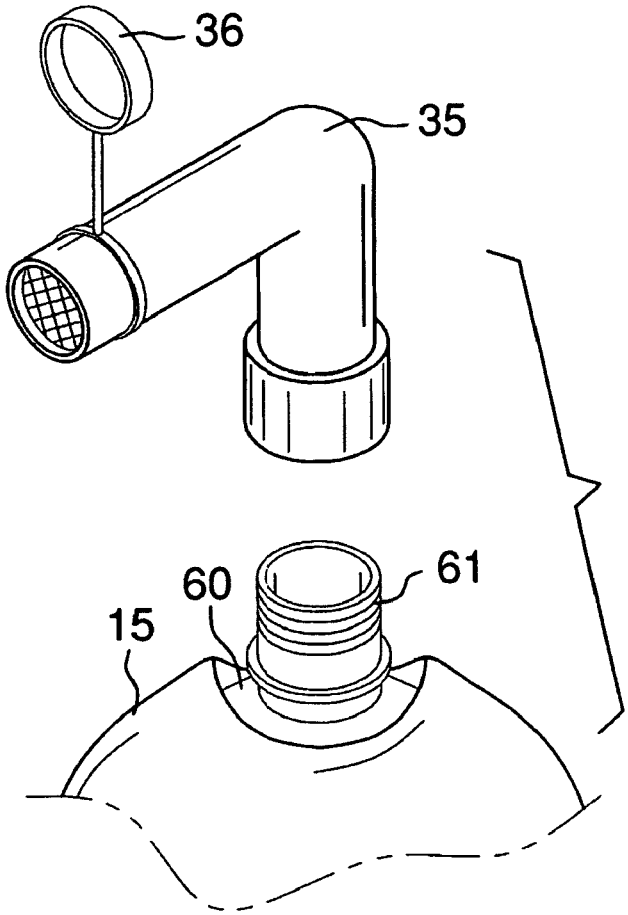
FIG. 5 illustrates a detailed view of the spout above the opening of the plastic bottle.
Figure 6:
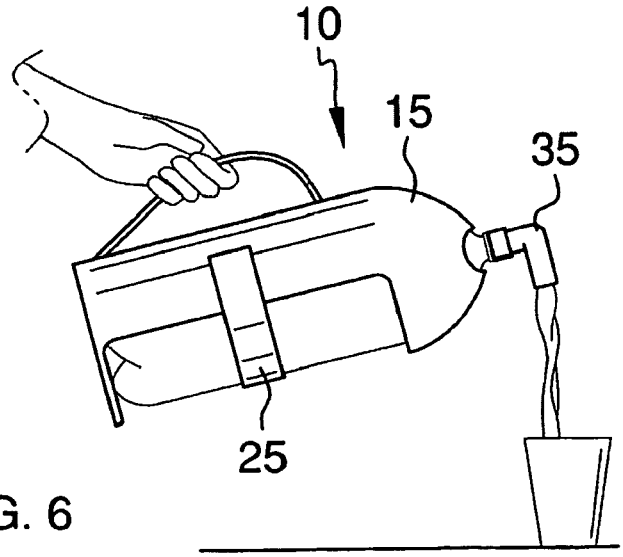
FIG. 6 illustrates the invention in use.

The base 15 has an opening 16 along a side for inserting a bottle 60. The base 15 has a top opening 17 that enables the top of the bottle 60 to protrude. The base 15 has a handle 18 for use in serving the contents of the bottle 60, as depicted in FIG. 6. The base 15 also has nylon hook and loop strips 19 located along the sides adjacent to the opening 16.

The adjustable strap 25 has nylon hook and loop strips 26 located at each end of the adjustable strap 25. The adjustable strap 25 is made from a flexible material comprising plastic, cotton, or rubber.

The nylon hook and loop strips 19 and 26 are fastening means for attaching the adjustable strap 25 to the base 15. Other fastening means may be employed and comprise snap buttons, hook and grommets, adhesives, and the like.

The spout 35 has internal threading (not shown) along the bottom for attaching the spout 35 to external threading 61 of the bottle 60. The opposing end of the spout 35 has a removable cap 36, which provides for sealing of the spout 35. The removable cap 36 is an important feature of the invention 10 in that it provides a means to seal off and preserve the contents of the bottle 60, especially carbonated beverages. The spout 35 is made from a material comprising plastic, metal, wood, or rubber.

It shall be noted that the invention 10 may be adapted for use with bottles 60 of varying sizes comprising one pint, one quart, two liter, and one gallon-sized containers.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

While the embodiments of the invention have been disclosed, certain modifications may be made by those skilled in the art to modify the invention without departing from the spirit of the invention.

The inventor claims:

1. An improved bottle holder and server comprising:

(a) a base;

wherein the base has a handle;

wherein the base has an opening for insertion of a bottle;

wherein the base has a top opening for the opening of the bottle to pass there through;

wherein the base has a bottom for supporting the bottom of the bottle;

(b) an adjustable strap;

wherein the adjustable strap and the base are adorned with attaching means;

wherein the adjustable strap traverses the opening of the base and attaches to the base so as to secure the bottle within the base;

(c) a spout;

wherein the spout has means of attachment along an opening of the spout of the bottle;

wherein the spout has closure means along an opposing opening of the spout for sealing off the bottle and the spout.

2. The improved bottle holder as described in claim 1 wherein the attaching means consists of adhesives, nylon hook and loop strips, hook and grommets, or snap buttons.

3. The improved bottle holder as described in claim 2 wherein the closure means consists of a screw cap.

4. The improved bottle holder as described in claim 3 wherein the base is made of a material consisting of plastic, rubber, metal, or wood.

5. The improved bottle holder as described in claim 4 wherein the adjustable strap is made of a flexible material consisting of plastic, cotton, or rubber.

6. The improved bottle holder as described in claim 5 wherein the spout is made of a material consisting of plastic, metal, rubber, or wood.

7. The improved bottle holder as described in claim 6 wherein the bottle is of a size consisting of one pint, one quart, two liter, and one gallon.

8. An improved bottle holder and server comprising:

(a) a base;

wherein the base has a handle and an opening for insertion of a bottle into said base;

wherein the base has a top opening for the opening of the bottle to pass there through;

wherein the base has a bottom for supporting the bottom of the bottle;

(b) an adjustable strap;

wherein the adjustable strap and the base are adorned with attaching means;

wherein the adjustable strap attaches to the base so as to secure the bottle within the base;

(c) a spout;

wherein the spout has means of attachment along an opening of the spout of the bottle;

wherein the spout has a screw cap along an opposing opening of the spout for sealing off the bottle and the spout.

9. The improved bottle holder as described in claim 8 wherein the attaching means consists of adhesives, nylon hook and loop strips, hook and grommets, or snap buttons.

10. The improved bottle holder as described in claim 9 wherein the base is made of a material consisting of plastic, rubber, metal, or wood.

11. The improved bottle holder as described in claim 10 wherein the adjustable strap is made of a flexible material consisting of plastic, cotton, or rubber.

12. The improved bottle holder as described in claim 11 wherein the spout is made of a material consisting of plastic, metal, rubber, or wood.

13. The improved bottle holder as described in claim 12 wherein the bottle is of a size consisting of one pint, one quart, two liter, and one gallon.

* * * * *